United States Patent [19]

Schisler et al.

[11] Patent Number: 4,500,095

[45] Date of Patent: Feb. 19, 1985

[54] INFLATABLE OIL WELL HOLE PLUG WITH REINFORCING WIRES

[75] Inventors: Robert C. Schisler; George W. Eisenzimmer, both of Akron, Ohio

[73] Assignee: The Goodyear Tire & Rubber Company, Akron, Ohio

[21] Appl. No.: 548,391

[22] Filed: Nov. 3, 1983

[51] Int. Cl.[3] ..... F16J 15/46

[52] U.S. Cl. ..... 277/34; 277/30; 277/230; 277/DIG. 6; 166/120; 166/187

[58] Field of Search ..... 277/12, 30–32, 277/34, 34.3, 34.6, 166, 230, DIG. 6; 166/120–122, 187

[56] References Cited

U.S. PATENT DOCUMENTS

| | | | |
|---|---|---|---|
| 2,381,248 | 8/1945 | Bascom | 277/DIG. 6 |
| 2,779,419 | 1/1957 | Mounce | 166/187 |
| 3,259,192 | 7/1966 | Hyde | 277/34.6 X |
| 3,401,946 | 9/1968 | Malone | 277/34.6 |
| 3,604,732 | 9/1971 | Malone | 277/34 X |
| 3,923,312 | 12/1975 | Hutchison et al. | 277/34.6 |
| 4,003,581 | 1/1977 | Hutchison | 277/34.6 |
| 4,191,383 | 3/1980 | Baker et al. | 277/230 X |

*Primary Examiner*—Robert S. Ward

*Attorney, Agent, or Firm*—J. D. Wolfe; R. D. Thompson

[57] ABSTRACT

An inflatable packer assembly having an inflatable bladder having reinforcing means where the steel wires are arranged as a series of parallel inline cables positioning within the bladder and their ends are anchored in an upper and a lower shoe means and is embedded in elastomeric compounds having preferably special physicals and a cover of a tough elastomer.

6 Claims, 4 Drawing Figures

INFLATABLE OIL WELL HOLE PLUG WITH REINFORCING WIRES

TECHNICAL FIELD

This invention relates generally to an inflatable packer assembly for use with a casing or other tubular member of a well fluid means more particularly, but not by way of limitation, to an inflatable bladder or means to be or incorporated with a mandrel assembly means to form an inflatable packer assembly or other down-hole tool.

PRIOR ART

An inflatable packer or an oil well hole plug is a down-hole tool which can be inflated with well fluid to seal off the annular space between, for example, the casing and the well bore. It may be used inside a casing. Inflatable packers may be used in a well for a variety of reasons. They can be used to support a column of cement above a lost circulation zone. They can be used to isolate producing zones from cementing operations. Also, they may be used to isolate production and lost circulation zones for gravel pack operations and other operations well known to the art.

The nature of the inflatable packer and its various elements is well known to the art as shown by U.S. Pat. Nos. 4,253,676 and 4,260,164. These inflatable packers have an inflatable bladder means which has an upper and lower support means. The reinforcing element and the upper integral support means of the inflatable bladder means are comprised of a plurality of layers of steel cable material or other similar reinforcing material. Thus, when the bladder is inflated, the steel cable in the plurality of layers or plies in the bladder are moved to exhibit a pantographing appearance which causes extreme sheer stresses within the bladder.

DISCLOSURE AND PRACTICE OF THE INVENTION

The inflatable packer assembly of this invention includes an inflatable packer element, comprising a first annular shoe means, a second annular shoe means axially spaced from said first shoe means, an inflatable bladder means connected between said first and second shoe means, and including a reinforcing means and wherein said reinforcing means includes a series of inline steel cables spaced parallel with the center axis of said bladder and having their ends securely fastened to said first and second shoe means, respectively, said series of inline parallel steel cable being embedded in an elastomeric composition having, when cured at 150° C. for 30 minutes, the following preferred characteristics: a tensile of at least about 10 $MN/M^2$, an elongation of about 300%, a Shore A hardness of about 65, and a H-test per ASTM D-2138 adhesion to 5 MM zinc coated steel cable of at least 500 psi and a cover preferably of a cured carboxylic terminated acrylonitrile butadiene rubber.

We have discovered that stresses developed during the inflation and deflation pantographing of the fabric or wire reinforcing elements in the prior art bladders can be reduced or eliminated by aligning the steel cable embedded in a suitable compounded elastomer parallel to the centerline axis of the bladder over an elastomeric tube and sealed at each end in a shoe means and then covering with a cover preferably of a cured carboxyl terminated acrylonitrile butadiene rubber. The aligned cables are laid down over the elastomeric tube in essential contact with each adjacent cable and spaced from the centerline of the bladder to give the desired diameter of the bladder.

The nature of this invention can be seen more readily by reference to the drawings where FIG. 1 is a schematic sectional elevation of a retrievable packer in place within a well and in the inflated position and FIG. 2 is a view in partial section of the inflatable bladder means in uninflated condition.

Figure 1:
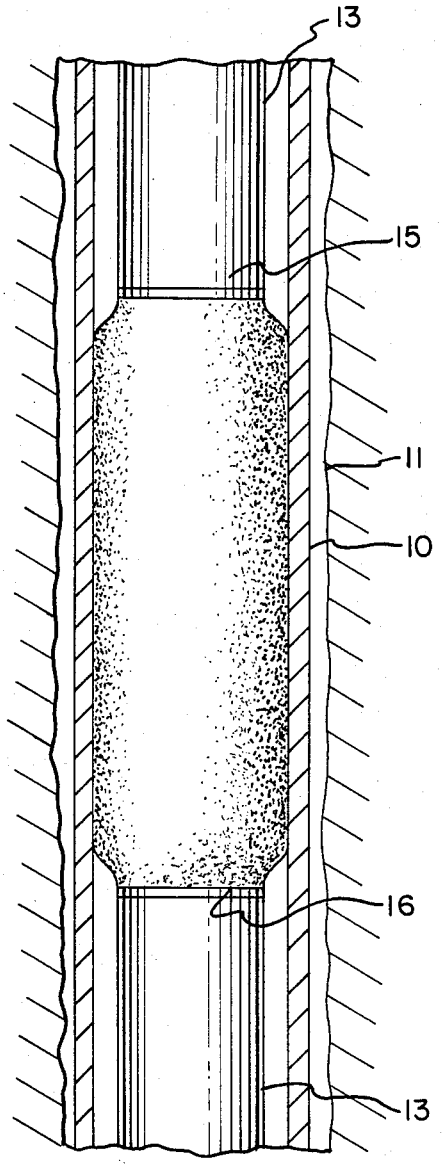

Referring specifically to FIG. 1, numerial 10, indicates the casing within the drill hole 11 and numerial 13 indicates a string of drill pipe having the inflatable packer assembly 14 positioned therein and connected to the drill pipe in its upper end 15 and lower end 16 of the inflatable packer assembly 14.

Figure 2:
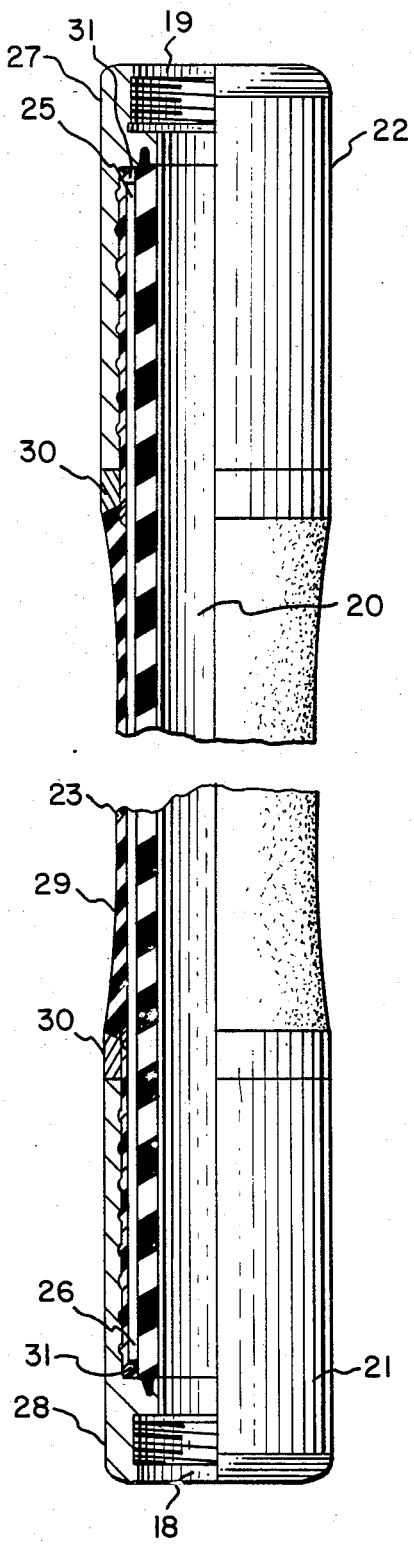

FIG. 2 shows the specific aspects and details of the inflatable packer assembly where numerials 18 and 19 respectively designate the treaded fittings for fastening the inflatable packer assembly to the drill pipe in the manner best seen in FIG. 1. The fittings 18 and 19 are attached or form part of a special tube, sometimes called the mandrel 20. The special tube 20 may have a threaded collar-like-like fitting 21 and 22 respectively that serves to couple the inflatable packer assembly to the drill pipe or other apparatus by means of a collar.

A series of inline steel cables 23 are laid up parallel with the centerline 24 of the bladder, or the special tube 20 and essentially in contact with the outer surface of the special tube but separated therefrom by a specially compounded elastomer of cushion stock 32. Each cable is laid adjacent the other cable until the circumference of the tube is covered with the cable. The upper end 25 and lower end 26 of the steel cables are anchored and fastened respectively in shoes which are sometimes referred to in the trade respectively as the sliding shoe 27 and the anchor shoe 28 by a potting material 31. The steel cables 23 are embedded in a specially compounded elastomer 32 having cured physicals, after 30 minutes at 150° C. as follows: tensile 8 to 15 $MN/M^2$, elongation 250 to 500% and a Shore A hardness of 50 to 80.

The steel cable is covered with a cover 29 of a compounded carboxyl terminated acrylonitrile butadiene rubber. The embedded steel cables have a high strength steel ring 30 thereover as shown in the drawings.

Figure 3:
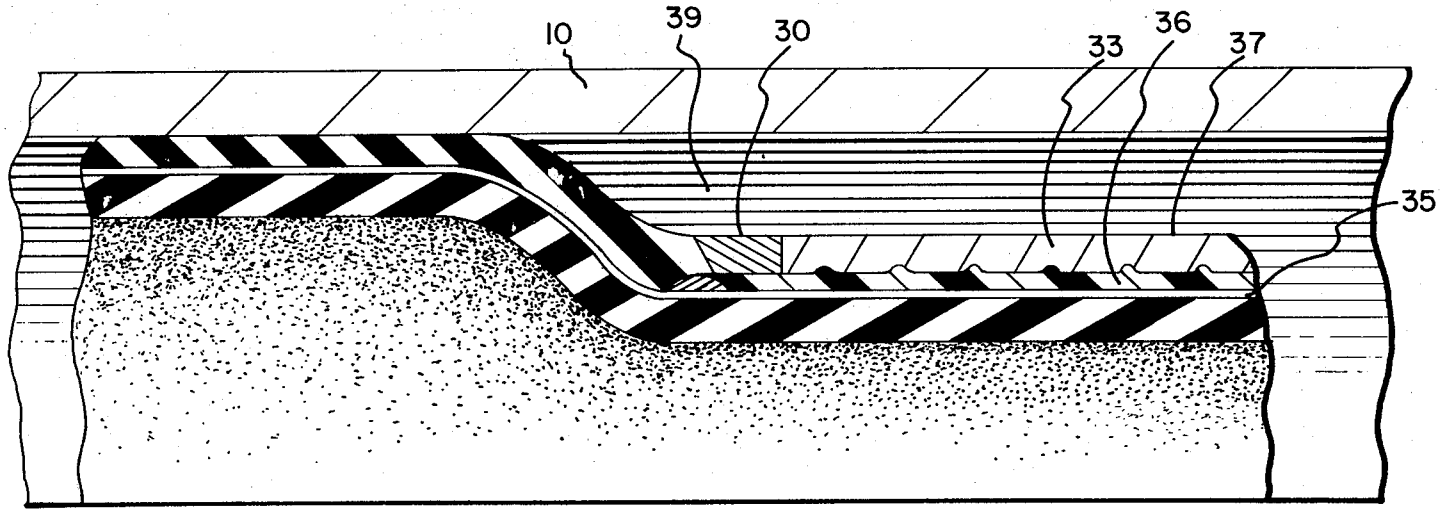
FIG. 3 is a partial sectional view of the packer in the inflated condition in the well casing.
Figure 4:
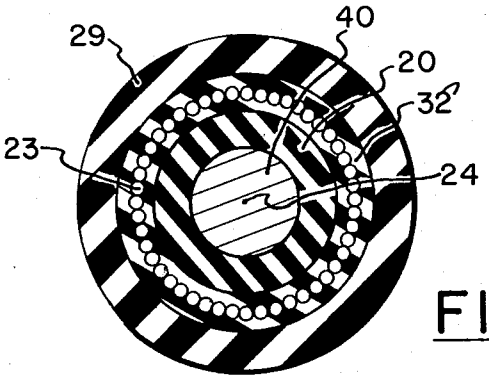
FIG. 4 is a cross-section through the bladder having the elastomeric tube positioned over the mandrel.

The inflatable bladder is built on a building mandrel 40 in many respects similar to the well known hose building techniques. Generally, a tube 20 of the desired diameter is extruded from a suitable elastomeric compound; for instance, the one described herein. The extruded tube 20 preferably has a wall gauge of about 1.2 to 1.8 cm and is slipped onto the bladder mandrel shown in FIG. 4 as numerial 40. The compounded elastomer for embedding the steel cable is spiral wrapped over the elastomeric tube to give a gauge of about 0.12 cm or more. The steel cables are laid axially parallel with the centerline 24 of the mandrel over the elastomeric compound, sometimes called cushion gum in side by side contact until the surface is covered. Then about 0.12 cm gauge of cushion gum is spirally wrapped over the cables. The steel cables are cut to the length desired for the inflatable bladder, but preferably are cut prior to being laid up over the tube. Each end of the laid up cables on the tube are anchored or attached to the anchor means 33 as seen in FIGS. 2 and 3 by being embedded in an epoxy potting adhesive, such as an epoxy adhesive preferably by injection to fill space in the steel shoe means. A cover 29 of an elastomer such as a carboxyl terminated acrylonitrile/butadiene polymer was applied preferably by spiral wrapping over the assembly to give the inflatable bladder, viz plug in the uncured state. The plug is wrapped with a suitable tape such as the well known hose wrap, viz a nylon shrink tape and placed in a steam autoclave for 90 minutes at 160° C. to give the cure. The inflatable bladder with building mandrel removed was put on test. It preformed performed satisfactory on test and exhibited great resistance to inflation-deflation wear.

A preferred compound for embedding the steel cables is given below: (on a part by weight basis)

| | |
|---|---|
| Copolymer of acrylonitrile/ butadiene 22% acrylonitrile | 100. |
| Hydrated silica | 80 |
| Plasticizers such as dialkyl phthalates | 35 |
| Zinc oxide | 5 |
| Sulfur | 3 |
| Accelerator, such as N—oxydiethylene benzothiazole-2-sulfenamide | 1.25 |
| Stearic acid | 0.50 |
| Di-ortho-tolyguanidine | 0.35 |
| Polymerized 1,2-dihydro-2,2,4-trimethylquinoline | 1 |
| Litharge | 3.50 |
| Carboxylic acid salt of cobalt | 5 |
| Hexamethoxy-methyl melamine | 2 |

This compound yields on 30 minute cure at 150° C. vulcanizates having tensiles of about 10 $MN/M^2$, elongation of about 350% and a Shore A hardness of 65. Another preferred one for the tube and cover stocks is made by the recipe below: (on part by weight basis)

| | |
|---|---|
| Blend of 50% weight of acrylonitrile/butadiene/carboxylic acid terpolymer and 50% polyvinyl chloride | 114 |
| Acrylonitrile/butadiene/ carboxylic acid terpolymer | 50 |
| Carbon black (HAF) | 60 |
| Tributoxy ethyl phosphate | 15 |
| Stearic acid | 2 |
| Calcium stearate | 2 |
| Zinc peroxide | 5 |
| Polymerized 1,2-dihydro-2,2,4-trimethylquinoline | 1 |
| N—oxydiethylene benzothiazole-2-sulfenamide | 1 |
| Tetraethyl thiuram disulfide | 3 |

This compound when cured 30 minutes at 150° C. yields a vulcanizate having a tensile of about 18 $MN/M^2$, an elongation of about 450%, stress at 100% strain of about 6.5 $MN/M^2$ and Shore A hardness of about 85. The elastomer of the tube has the following vulcanizate physical's tensile of about 15–20 $MN/M^2$, an elongation of about 300–500%, and a Shore A hardness of about 75 to 95, and stress at 100% strain of about 6.5 $MN/M^2$.

It is amazing to find that the commercial epoxy resin adhesive will serve as a potting adhesive to anchor the ends of the cables in the shoe means. It is preferred to apply the adhesive by the well known injection gun technique. Representative of these epoxy resins are the bisphenol A/epichlorohydrin condensates, such as Epon TM 828. It usually is used as a blend of about 190 parts by weight with a curative such as a liquid polyamide resin of about 140 parts by weight as the adhesive or potting adhesive. Other commercial and well known epoxy resins with the polyamide and related cure systems can be used to anchor the cables in the shoe means.

A bladder made according to this invention is shown in partial section in FIG. 3 to further illustrate how the bladder works in the inflated position. The embedded cables 35 anchored by the potting material 36 in the shoe means 37 are retained against outward movement in the shoe means by ring 30, of high tempered steel but in the space 39 between the upper and lower shoe means the bladder expands under pressure on the drill string until it contacts the wall 10 of the well casing to effectively block the opening of the well casing. Thus, the bladders made according to this invention were able to perform satisfactory and to eliminate the prior art stress problems due to pantographing of the ply.

We have discovered that those elastomeric compositions exhibiting physical after being cured 30 minutes at 150° C. of 8 to 15 $MN/M^2$ of tensile, 250 to 300% of elongation, 50 to 80 Shore A hardness and an adhesion to 5 mm zinc coated steel cable of at least 500 psi permits the tube and cables to be embedded therein in parallel alinement with the center line and to be inflated and extend required by an inflation bladder without elastomer blowing out between the parallel cables whereas the prior art inflatable bladders depended on a series of bias plies where the crossed wires in the plies prevented the blow out.

While certain representative embodiments and details have been shown for the purpose of illustrating the invention, it will be apparent to those skilled in this art that various changes and modifications may be made therein without departing from the scope of the invention.

We claim:

1. An inflatable packer element, comprising a first annular shoe means;

a second annular shoe means axially spaced from said first shoe means;

an inflatable bladder means connected between said first and second shoe means, and including a reinforcing means; and said reinforcing means comprising a series of inline steel cables spaced parallel with the center line of said bladder and having their ends securely fastened to said first and second shoe means, respectively, said series of inline parallel steel cables being embedded in an elastomeric composition over an elastomeric tube and having a cover of a tough elastomer.

2. The element of claim 1 wherein the packer element has a series of parallel inline steel cables embedded in an elastomeric composition that exhibits the following properties when cured 30 minutes at 150° C., a tensile of 8 to 15 $MN/M^2$, elongation of 250 to 500%, a Shore A hardness of 50 to 80, and an H-test per ASTM D-2138 adhesion to 5 MM zinc coated steel cable of at least 500 psi.

3. The element of claim 1 wherein the cover is a carboxylated terminated acrylonitrile butadiene polymer.

4. The element of claim 1 wherein the elastomer of the tube has a gauge of at least 1.2 cm. and is composed of an elastomeric vulcanizate having a tensile of about 15–20 $MN/M^2$, an elongation of about 300–500%, and a Shore A hardness of about 75 to 95, and stress at 100% strain of about 6.5 $MN/M^2$.

5. The element of claim 1 wherein the ends of the cables are fastened in the shoe means by an epoxy resin potting adhesive.

6. The element of claim 2 wherein the ends of the cables are fastened in the shoe means by an epoxy resin potting adhesive.

* * * * *